United States Patent [19]

Palau

[11] 4,422,481

[45] Dec. 27, 1983

[54] ADJUSTABLE FASTENER FOR FASTENING PULLING CABLES ON THE SUSPENSION LEVERS OF TEXTILE DOBBIES OF THE NEGATIVE TYPE

[75] Inventor: Joseph Palau, Duingt, France

[73] Assignee: S.A. Des Etablissements Staubli, Faverges, France

[21] Appl. No.: 340,178

[22] Filed: Jan. 18, 1982

[30] Foreign Application Priority Data

Jan. 30, 1981 [FR] France ..... 81 01980

[51] Int. Cl.[3] ..... D03C 13/00

[52] U.S. Cl. ..... 139/88; 24/115 R; 403/41

[58] Field of Search ..... 139/82, 84, 88; 24/115, 24/122.3, 122.6, 132 AA, 136 L; 403/41

[56] References Cited

U.S. PATENT DOCUMENTS

| | | | |
|---|---|---|---|
| 1,871,308 | 8/1932 | Dodge et al. | 139/88 |
| 2,680,273 | 6/1954 | Brickman | 139/88 |
| 2,919,722 | 1/1960 | Alford | 139/88 |
| 3,262,469 | 7/1966 | Blakely | 139/84 |
| 3,614,098 | 10/1971 | Carr | 24/115 |
| 3,739,457 | 6/1973 | Davis | 24/112.6 |
| 4,055,365 | 10/1977 | Kucherry | 24/112.6 |

FOREIGN PATENT DOCUMENTS

| | | | |
|---|---|---|---|
| 562492 | 9/1923 | France | 139/84 |

*Primary Examiner*—Henry Jaudon
*Attorney, Agent, or Firm*—Dowell & Dowell

[57] ABSTRACT

The present invention relates to an adjustable fastener for fastening pulling cables to the suspension levers of textile dobbies of the negative type, said fastener being constituted by two parallel side elements which support a pin for the pivoting connection of the fastener to the end of the corresponding suspension lever, a curved lower guide, and an upper stop provided with two forks which are traversed by threaded end pieces fixed to the pulling cables and which form support for adjusting nuts.

3 Claims, 1 Drawing Figure

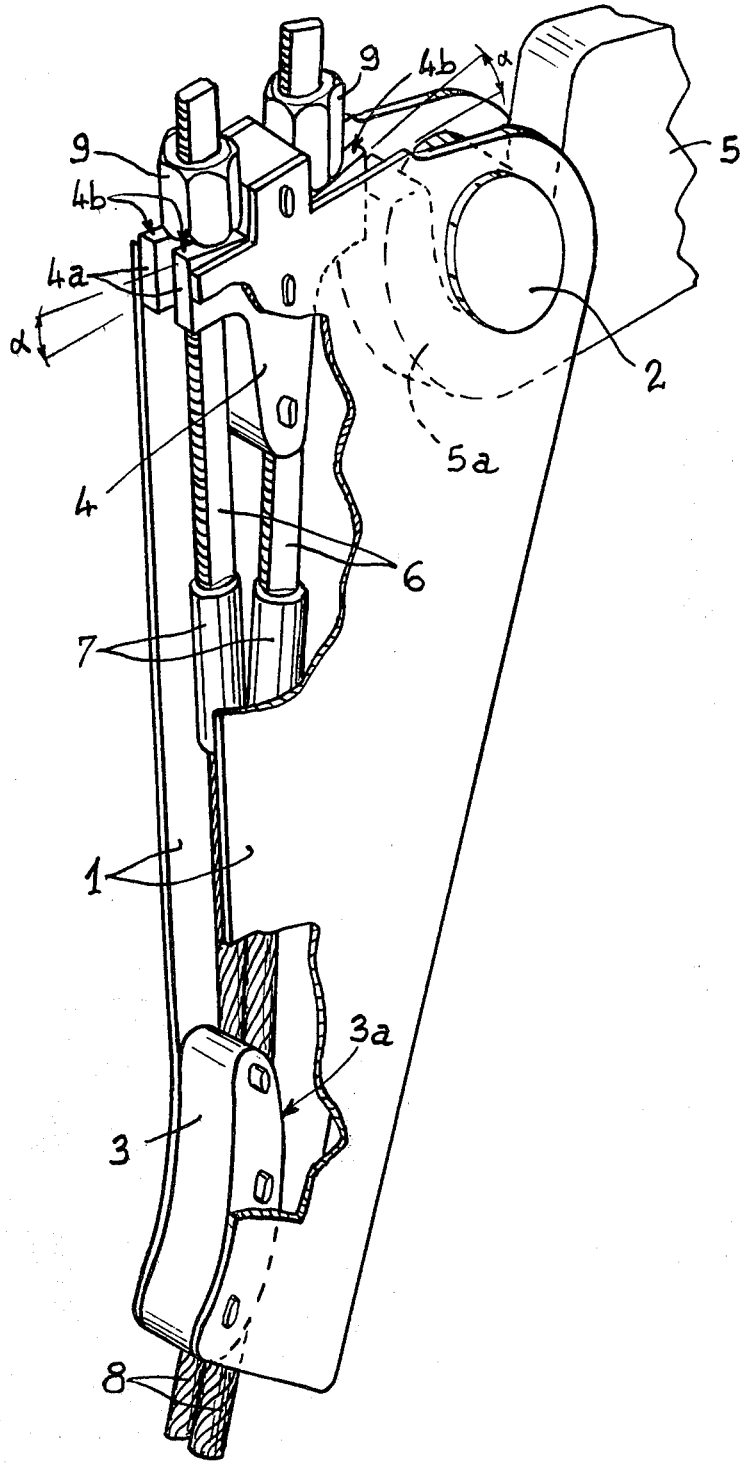
9
4b
α
5
9
4b
4a
α
2
5a
4
6
7
1
3a
3
8

ADJUSTABLE FASTENER FOR FASTENING PULLING CABLES ON THE SUSPENSION LEVERS OF TEXTILE DOBBIES OF THE NEGATIVE TYPE

The present invention relates to devices interposed between dobbies and other textile mechanisms and the frames carrying the heddles traversed by the warp yarns stretched on the loom, which frames are selectively lifted and lowered as a function of the weave of the fabric being produced, and it relates more particularly to dobbies of the negative type in which the connecting device comprises, between each suspension lever of the dobby in question and the corresponding heddle frame, at least one cable guided by guide pulleys provided between the lever and the associated frame.

In conventional constructions, the ends of these cables are generally fastened in empirical manner with the aid of simplified hooks which, most often, do not lend themselves to easy adjustment of the length of the cables concerned and of the exact position of the frames.

It is an object of the present invention to remedy this drawback by providing an improved fastener which allows an easy, precise initial adjustment, whilst subsequently opposing any undesired misadjustment and facilitating installation of the cables on the weaving loom.

The fastener according to the invention is noteworthy in that it is constituted by two side elements which support a lower guide of curved section forming a support for at least one pulling cable, an upper transverse pin adapted to cooperate with the end of a dobby suspension lever, a stop provided at the level of said pin and having a substantially cruciform section, and a threaded end piece connected to the end of each cable and engaged between the forked arms of the said stop, in order to receive thereabove an adjusting and lock nut.

The invention will be more readily understood on reading the following description with reference to the accompanying drawings, in which:

The single FIGURE is a view in perspective, with parts torn away, showing a fastener according to the invention.

The fastener shown essentially comprises two vertical side elements 1 between which are engaged a pin 2, a lower guide 3 and a stop 4. In the embodiment considered, it has been assumed (and this appears to be the most advantageous solution) that the two side elements 1 were assembled together by the three members 2, 3 and 4, but this arrangement is not compulsory. Intercalated spacers may be provided to this end.

The pin 2 provided in the upper part of the side elements 1 is constituted by a cylindrical pin fixed to said side elements by welding or by riveting; this pin 2 is adapted to be received in the end 5*a*, in the form of a cradle or hook, of one of the suspension levers 5 of the dobble shown, so that said fastener is thus pivotally supported on its lever 5. The lower guide 3 is formed by an elongated piece, provided at the vertical edge of the side elements 1 opposite the edge occupied by pin 2; the inwardly facing face of this guide 3 has a curved section referenced 3*a*, of inwardly oriented convexity.

The stop 4 is connected between the side elements 1 in the upper part thereof, substantially at the level of pin 2 and plumb with the lower guide 3. It has a cross-shaped section of which each of the horizontal arms is cut out to determine a sort of fork 4*a* open on three sides; in each of these forks 4*a* is engaged, with reduced clearance, a threaded rod 6, machined to present two opposite flat portions which oppose any rotation of said rod once it is housed in the fork 4*a*. The base of each rod 6 is axially fixed to a sleeve 7, the two sleeves 7 being crimped on the upper end of the pulling cables 8 which ensure the connection between the hook element 5 and the corresponding heddle frame.

That part of each rod 6 which projects above the fork 4*a* which it traverses receives a nut 9 adapted, by screwing, to abut against the face of this fork 4*a* which faces upwardly, and it will be noted that this face, referenced 4*b*, is inclined inwardly by an angle $\alpha$ thus tending to apply the nut 9 against the top part of the stop 4 which axially projects above the arms or forks 4*a*.

The functioning and use of the double fastener described hereinabove will follow from the foregoing explanations and will be radily understood.

The lower ends of the two cables 8 are fastened to the heddle frame corresponding to the suspension lever 5. The rods 6 of the end assemblies 6–7 are engaged in the forks 4*a*, the nuts 9 having been previously positioned, by loosening, level with the upper end of each of said rods. To effect adjustment of the length of the cables 8 and the precise position of the heddle frame associated therewith, it then suffices to screw each nut 9 on its rod 6. It will be noted that this operation is facilitated by the fact that the rods 6 are retained angularly by their flat portions bearing against the edges of the forks 4*a* and that, as soon as the desired adjustment has been obtained, no undesired loosening can occur since the slope of the upper faces 4*b* tends to apply the nuts 9 against the stop 4 which thus opposes any rotation of said nuts.

It should further be observed that the particular arrangement of the lower guide 3 and of the upper stop 4 of the fastener makes it possible to dispose the cables 8 very advantageously. In fact, below the guide 3, these cables 8 are juxtaposed along a plane perpendicular to the general axis of the fastener, so that they may wind on a double guide pulley. On the other hand, above said guide, the cables 8 and their end assemblies 6–7 are disposed along the plane defined by the side elements 1, so that the nuts 9 are perfectly accessible for adjustment, without the total thickness of the fastener having to be increased thereby.

It must, moreover, be understood that the preceding description has been given only by way of example and that it in no way limits the scope of the invention, the replacement of the details of execution described by any other equivalent means not departing from the scope thereof. In particular, the fastener may be arranged for fastening a number of suspension cables greater than two.

What is claimed is:

1. An adjustable fastener for fastening pulling cable means to the suspension levers of textile dobbies of the negative type, wherein said fastener comprises two parallel side elements between which are mounted a transverse pin adapted to cooperate with the end of a suspension lever, a lower guide of curved section forming support for said cable means, and an upper stop comprising forked arm means oriented in the mean plane of the side elements so as to constitute a support for adjusting and locking nut means screwed on the upper ends of corresponding end piece means fixed to the cable means and passing through the said forked arm means.

2. The fastener of claim 1, wherein each end piece means comprises a lower sleeve crimped on the end of a corresponding cable means and a threaded rod presenting two opposite flat portions for engagement thereof in a forked arm means of the upper stop, which arm means thus opposes any rotation of the end piece means when the nut is being adjusted.

3. The fastener of claim 1, wherein the stop has an upper extension and the upper face of each forked arm means of the stop is inclined toward the upper extension with an inclination which tends to maintain the corresponding nut means applied against said extension of said stop, thus opposing any loosening of the nut.

* * * * *